US011732557B2

(12) United States Patent
Boothe et al.

(10) Patent No.: US 11,732,557 B2
(45) Date of Patent: Aug. 22, 2023

(54) BUMPER SPRING

(71) Applicant: Liberty Lift Solutions, LLC, Houston, TX (US)

(72) Inventors: Nathan Boothe, Piedmont, OK (US); Clint Garrett, Moore, OK (US)

(73) Assignee: Liberty Lift Solutions, LLC, Houston, TX (US)

( * ) Notice: Subject to any disclaimer, the term of this patent is extended or adjusted under 35 U.S.C. 154(b) by 0 days.

(21) Appl. No.: 17/399,800

(22) Filed: Aug. 11, 2021

(65) Prior Publication Data

US 2023/0051529 A1 Feb. 16, 2023

(51) Int. Cl.
*E21B 43/12* (2006.01)
*F04B 47/12* (2006.01)

(52) U.S. Cl.
CPC ..... *E21B 43/121* (2013.01); *F04B 47/12* (2013.01)

(58) Field of Classification Search
CPC ..... E21B 43/121; E21B 43/13; F04B 47/12
See application file for complete search history.

(56) References Cited

U.S. PATENT DOCUMENTS

| | | | | |
|---|---|---|---|---|
| 2,147,585 | A * | 2/1939 | Trotter | E21B 17/04 175/83 |
| 9,869,401 | B1 | 1/2018 | Boyd et al. | |
| 10,060,235 | B2 | 8/2018 | Damiano et al. | |
| 10,677,027 | B2 | 6/2020 | Boyd et al. | |
| 2012/0036913 | A1* | 2/2012 | Johnson | B21J 15/041 72/370.05 |
| 2014/0116714 | A1 | 5/2014 | Jeffries et al. | |
| 2016/0208830 | A1* | 7/2016 | Boyd | F16F 1/128 |
| 2021/0047904 | A1 | 2/2021 | Boyd et al. | |

FOREIGN PATENT DOCUMENTS

| | | |
|---|---|---|
| CA | 2705086 C | 5/2017 |

* cited by examiner

*Primary Examiner* — George S Gray
(74) *Attorney, Agent, or Firm* — Ramey LLP

(57) ABSTRACT

A plunger lift system includes a bumper assembly to reduce the impact of the plunger at the bottom of the well and in some circumstances to reconfigure the plunger for the plunger's next ascent. The bumper assembly has a spring, a mandrel, an impact head, and a flow cage. The impact head and mandrel are constructed from a single piece of material thereby removing a joint between the impact head and mandrel. The unitary impact head/mandrel is connected to the flow cage using a first cooperating shoulder at the lower end of the unitary impact head/mandrel and a second cooperating shoulder within the flow cage. The first cooperating shoulder and the second cooperating shoulder are held in place with respect to each other by a force provided by the spring.

6 Claims, 8 Drawing Sheets

BUMPER SPRING

BACKGROUND

Generally when a well is drilled at least one hydrocarbon bearing formation is intersected. Part of the process of completing the well includes installing a liner within the well where the liner also intersects the hydrocarbon bearing formation. Once the liner is in place ports are opened up through the liner so that fluids, usually at least water and oil, may flow from the hydrocarbon bearing formation to the interior of the liner. In a newly completed well, in many instances, there is sufficient pressure within the hydrocarbon bearing formation to force the fluid from the hydrocarbon bearing formation to the surface. After some period of time the pressure gradient drops to the point where the fluids from a hydrocarbon bearing formation are no longer able to reach the surface and residual liquid accumulates in the wellbore. This liquid creates a back pressure against the reservoir, further reducing production flow and thus generating a further buildup of liquid.

Once the fluids are no longer able to naturally reach the surface artificial lift may be employed. One form of artificial lift is known as plunger lift. Plunger lift uses a piston, generally referred to as a plunger, which use the flow produced by the well to lift liquid from the well by acting as an interface between the driving flow beneath the plunger and the liquids above it. This technique has become popular in wells with sufficient gas to lift a liquid load using the plunger interfaces piston as it requires no external energy source.

Plunger lift requires the well to be shut-in utilizing a valve at the wellhead to stop the flow allowing the plunger to fall to the bottom of the production string. When the plunger reaches the bottom of the well and sufficient pressure builds below the plunger the well is opened and the plunger pushes the liquid above the plunger to the wellhead as the plunger moves upwards in the well driven by the gas below it. Whereby the plunger functions as mechanical interface between the gas flow pushing upwardly from below and the liquid above it. Upon arriving at the wellhead the well can be shut in immediately restarting the cycle or the plunger may be held at the wellhead while the well continues to flow during what is called "afterflow" or until a particular well pressure is reached after which the well is then shut in again and the plunger falls thereby restarting the cycle.

Generally, plungers are one of 2 types, a more or less solid plunger or a plunger with ports through it that shift open or closed depending upon the cycle that the plunger is in. When the well is shut in such that the plunger is traveling downward through the fluid towards the bottom of the well usually the fluid interacts with the plunger to reduce the plunger's speed as the plunger descends in the well so that when the plunger reaches the bottom of the well the plunger will stop without any damage to the lower end of the production string. In some cases, the velocity of the plunger reaches a point where assistance is required in order to safely stop the plunger. Therefore, it is become common to mount a bumper assembly at the lower end of the production tubing. The bumper assembly typically includes at least a spring, a mandrel to guide the spring, an impact head between the spring and the plunger, and an attachment assembly at the lower end of the bumper assembly to attach the bumper assembly to the production tubing. In many instances the impact head is configured to include a fishing neck to allow the bumper assembly to be retrieved and may be used to shift the plunger if the plunger requires shifting between open and closed conditions.

Current bumper assemblies attach the impact head to the spring using threads, pins, and or welding to attach the impact head, the spring, the mandrel and the lower attachment assembly together. Unfortunately, over time the impact of the plunger with the impact head destroys the connection between the spring and the impact head.

SUMMARY

In an embodiment of the present invention threads, pins, welding, or other contrivances used to connect the spring to the impact head are eliminated by utilizing interlocking components held together by the tension of the spring.

The present invention or bumper assembly's major components are a flow cage, a mandrel, an impact head, and a spring. The impact head and the mandrel are integrated into a single unit. The flow cage is slotted to receive the unitary mandrel/impact head and allows for the flow of well fluids and gas. The flow cage attaches to an assortment of tubing retention components.

The one-piece mandrel and impact head combination passes through the spring and attaches to the flow cage slot with a protruding latching end. The impact head provides a landing surface for the plunger/free piston while the spring absorbs the energy of the plunger/free piston. The spring is held between the mandrel/impact head and the flow cage. A retaining ring may be placed over the mandrel between the spring and the cage to provide an additional lock to maintain the flow cage and the mandrel in their relative positions.

The bumper assembly is assembled by compressing the spring on the mandrel thereby exposing the latching end of the mandrel. A retaining ring is placed over the mandrel latching end. The flow cage is oriented at a 90-degree angle to the mandrel latch such that a slot in the flow cage is lined up with latch end of the mandrel. With the spring still compressed the latch end of the mandrel is then threaded through the slot into the flow cage. With the latch end of the mandrel within the flow cage the flow cage is then re-oriented to be co-axial with the mandrel. The spring is then slowly released so that the retaining ring is forced into position by the spring and the tension from the spring holds the flow cage in position with regard to the mandrel.

Advantages and other features of the invention will become apparent from the following drawing, description and claims.

DETAILED DESCRIPTION

The description that follows includes exemplary apparatus, methods, techniques, or instruction sequences that embody techniques of the inventive subject matter. However, it is understood that the described embodiments may be practiced without these specific details.

Figure 1:
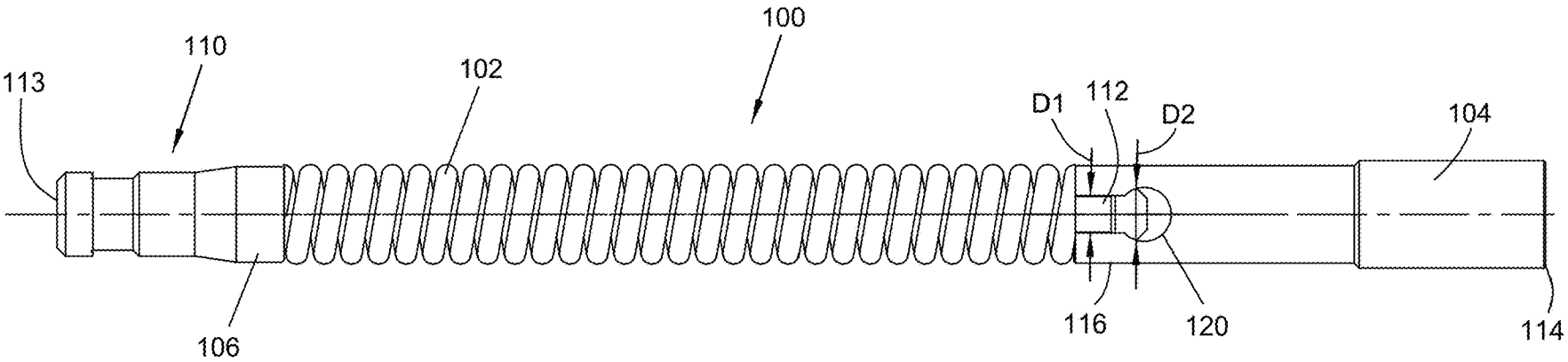
FIG. 1 is a side view of the assembled bumper spring having a spring, a flow cage, and an impact head with a unitary mandrel.

FIG. 1 depicts an embodiment of the present invention, a bumper assembly 100 having a spring 102, a flow cage 104, and an impact head 106 and in this embodiment a unitary mandrel. Usually, the impact head/mandrel 106 is at the upper end of the bumper assembly 100 while the flow cage 104 is at the lower end of the bumper assembly. The impact head/mandrel 106 has a circumferential profile 110, sometimes referred to as a fishing neck, that cooperates with the fishing tool to allow the bumper assembly to be placed or retrieved from the surface. An impact surface 113 is generally coaxial with and perpendicular to the long axis of the spring 102. The impact head/mandrel 106 is unitary with a mandrel (not shown) that extends through the interior coils of the spring 102 and ultimately extends through the bottom of the spring 102 and includes a circumferential profile 112. Where the circumferential profile 112 includes a portion that has a first diameter $D_1$ and a second diameter $D_2$ where the second diameter $D_2$ is larger than the first diameter $D_1$ and the second diameter is distally located from the impact surface 113. The flow cage 104 includes on its lower end 114 a connector that allows the bumper assembly 100 to be attached to the production tubing (not shown). The flow cage on its upper end 116 includes a slot 120. The slot 120 includes a first portion having a slot width wider than the first diameter $D_1$ but narrower than the second diameter $D_2$. At the lower end of the slot 120 is an opening that allows the circumferential profile 112 second diameter $D_2$ to pass through the slot into the interior of flow cage 104. Generally, the flow cage 104 must be turned at a roughly 90° angle to the central axis of the impact head/mandrel 106 to allow the circumferential profile 112 second diameter to pass through the slot 120 into the interior of flow cage 104.

Figure 2:
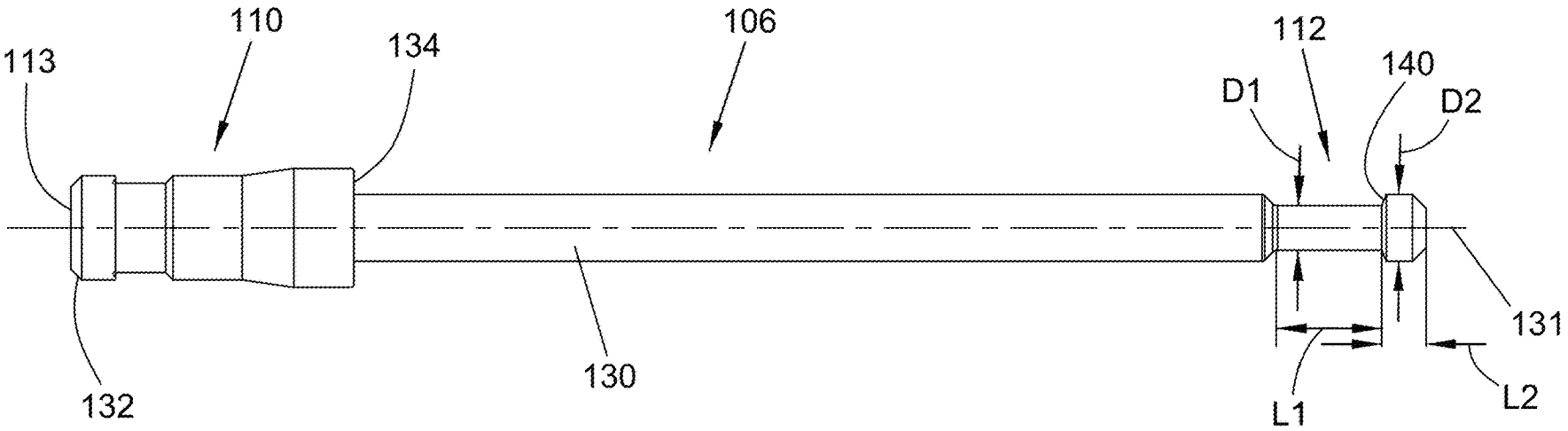
FIG. 2 is a side view of the impact head/mandrel.

FIG. 2 is a side view of the impact head/mandrel 106 from FIG. 1. The impact head/mandrel 106 includes the impact surface 113, the circumferential profile 110, a mandrel 130, and distally located from the impact surface 113 a circumferential profile 112. At an upper end 132 of the impact head/mandrel 106, circumferential profile 110 has an area of increased diameter forming shoulder 134. Shoulder 134 provides a first surface for the spring 102 to act upon. At the lower end of the impact head/mandrel 106, circumferential profile 112 has an area of reduced diameter $D_1$ that has a length $L_1$. Circumferential profile 112 has a second area having a diameter $D_2$ and a length $L_2$. As depicted, circumferential profile 112 preferably transitions from diameter $D_1$ to diameter $D_2$ at an essentially 90° angle forming a shoulder 140. In some instances, the transition from diameter $D_1$ to diameter $D_2$ may be at a rate that forms a multiplicity of profiles from circular to square.

Figure 3:
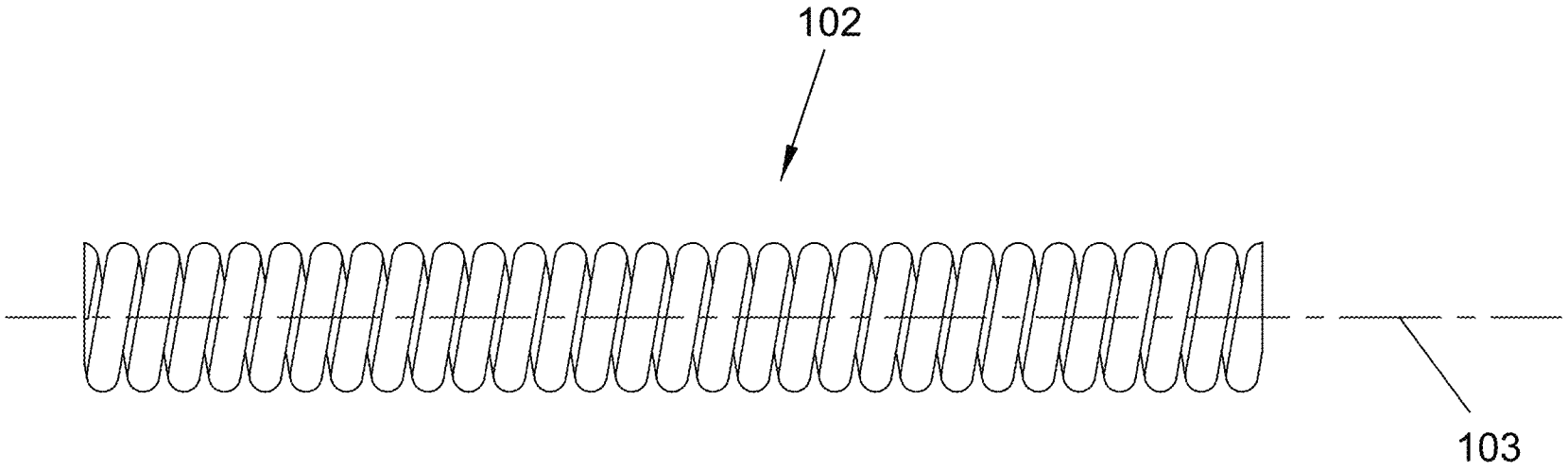
FIG. 3 is a side view of the spring.

FIG. 3 is a side view of the bumper spring 102. The bumper spring 102 is usually a wound coil spring having a centerline 103 and a hollow center (not shown).

Figure 4:
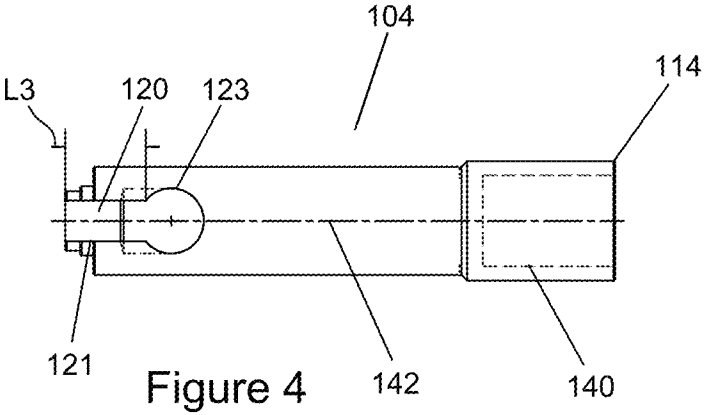
FIG. 4 is a top view of the flow cage.

FIG. 4 is a top view of the flow cage 104. The flow cage 104 has at its lower end 114 a connection profile 141 that allows the flow cage 104 and thus the bumper assembly 100 to be attached at the lower end of the production assembly which may include the production tubular, the well casing, or some other feature within the well. The flow cage 104 has at its upper end a slot 120. The slot 120 has an enlarged area 123 that allows the portion of the circumferential profile 112 having a diameter $D_2$ to be inserted into the slot 120's enlarged area 123. The slot 120 also has another portion 121 that allows the portion of the circumferential profile 112 having a diameter $D_1$ to be moved within the portion 121 of slot 120. The portion 121 of slot 120 has a length $L_3$ where $L_3$ is less than $L_1$ in order to allow the area of reduced diameter $D_1$ of circumferential profile 112 to fit fully within slot 121. It is important to note that the portion of circumferential profile 112 having a diameter $D_2$ is larger than and will not fit within portion 121 of slot 120.

Figure 5:
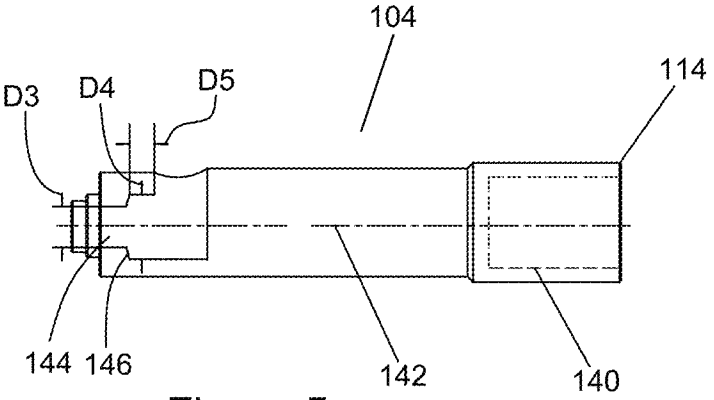
FIG. 5 is a side view of the flow cage.

FIG. 5 is a side view of the flow cage 104. The flow cage 104 has at its lower end a connection profile 141 that allows the flow cage 104 to be attached to the lower end of the production assembly. At the upper end of the flow cage 104 and generally coaxial with flow cage 104 about the centerline 142 is a first bore 144. The first bore 144 has diameter $D_3$ that generally corresponds with portion 121 of slot 120. The first bore 144 has a second diameter $D_4$ that generally corresponds with portion 123 of slot 120. A shoulder 146 is formed within bore 144 at the interface of diameter $D_4$ and diameter $D_3$. While generally diameter $D_4$ corresponds with portion 123 of slot 120 a portion of bore 144 diameter $D_4$ extends towards the upper end of the interior of flow cage 104, generally corresponding to slot 121. The bore 144 is generally radially open in one direction adjacent to both diameters $D_3$ and $D_4$ corresponding respectively to portion 121 and 123 of slot 120.

Figure 6:
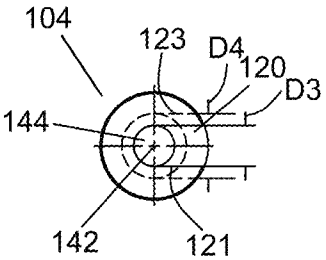
FIG. 6 is an end view of the upper end of the flow cage.

FIG. 6 is an end on view from the upper end of the flow cage 104. As can be seen in FIG. 6 flow cage 104 has a bore 144. The bore 144 has a diameter $D_3$ and a second diameter $D_4$. Where diameter $D_4$ is larger than diameter $D_3$. Slot 120 has a first portion 121 that has a width generally equivalent to diameter $D_3$ and a second portion 123 it is generally equivalent to diameter $D_4$.

Figure 7:
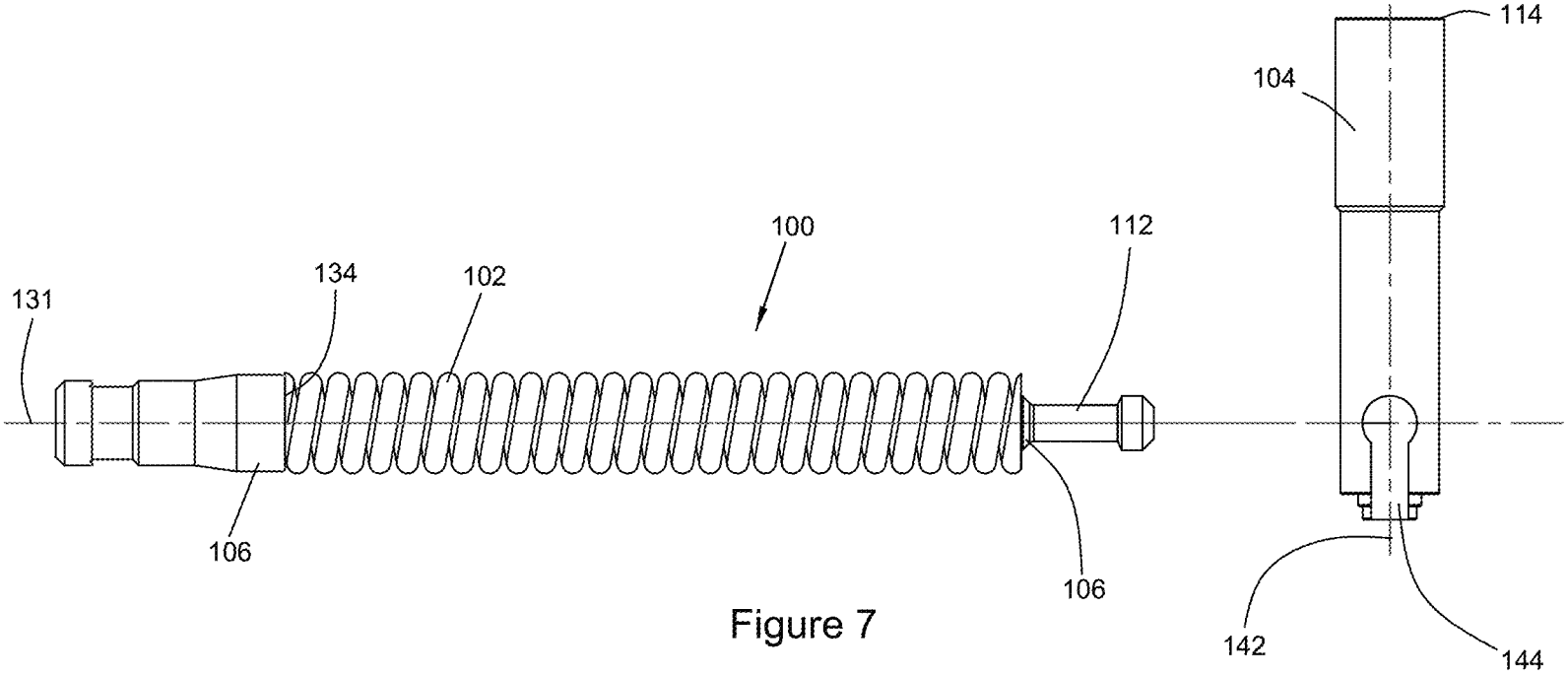
FIG. 7 is a side view of the bumper assembly in a semi-assembled state.

FIG. 7 depicts the bumper assembly 100 in a semi-assembled state. The spring 102 is placed such that at least a portion of the impact head/mandrel 106 passes through the center of and is coaxial with the spring 102. The upper end of spring 102 contacts shoulder 134. The spring 102 is then at least partially compressed such that circumferential profile 112 extends out past the lower end of spring 102 preferably for at least length $L_3$ and $L_2$. Preferably $L_3$ is greater than $L_1$ but in any event $L_3$ is at least equal to $L_1$. With the circumferential profile 112 exposed, the flow cage 104 is placed such that the centerline 142 of flow cage 104 is at a roughly 90° angle to the centerline 131 of the head/mandrel 106.

Figure 8:
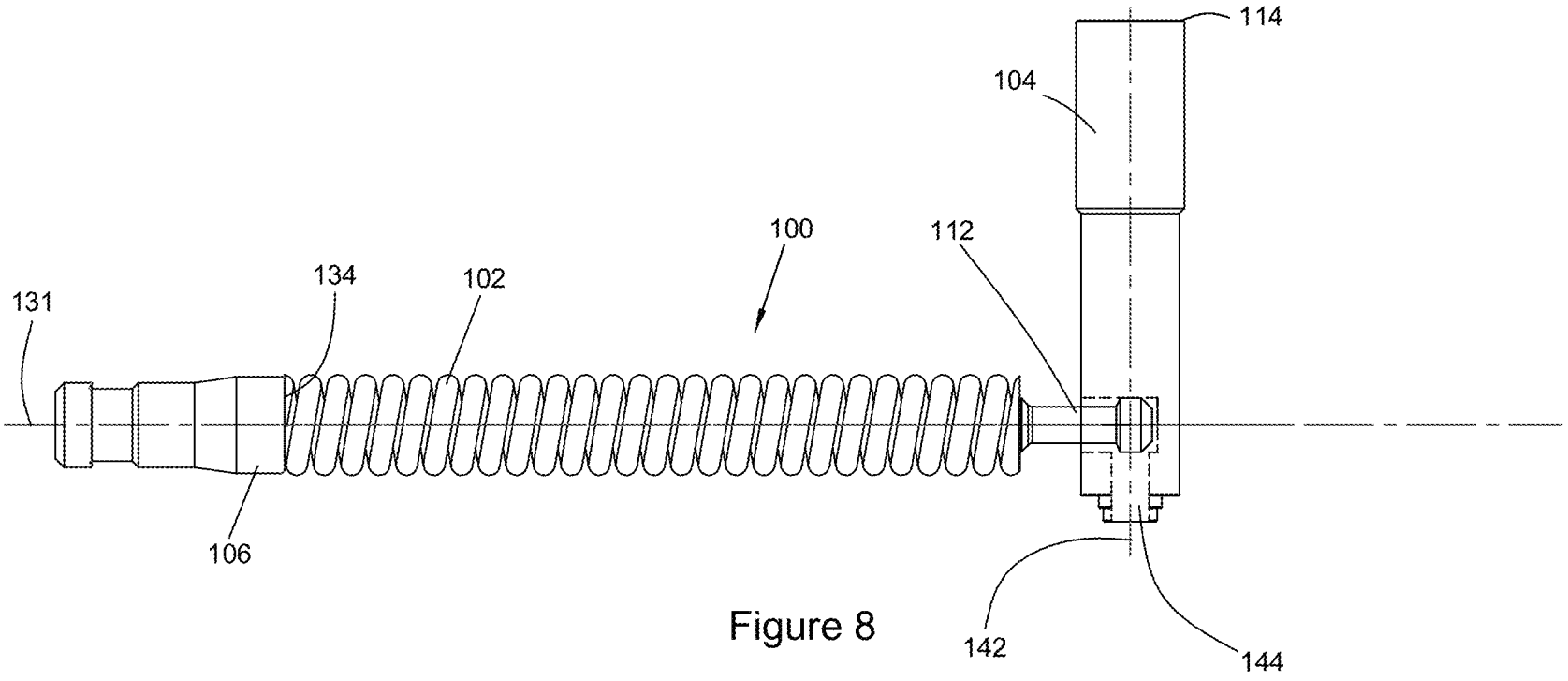
FIG. 8 is a side view of the bumper assembly having the impact head/mandrel inserted into the flow cage.

In FIG. 8 the impact head/mandrel 106 is moved such that the portion of circumferential profile 112 having diameter $D_2$ is inserted into the first portion 123 of slot 120 which has an opening large enough for the portion of circumferential profile $D_2$ to pass into the interior bore 144.

Figure 9:
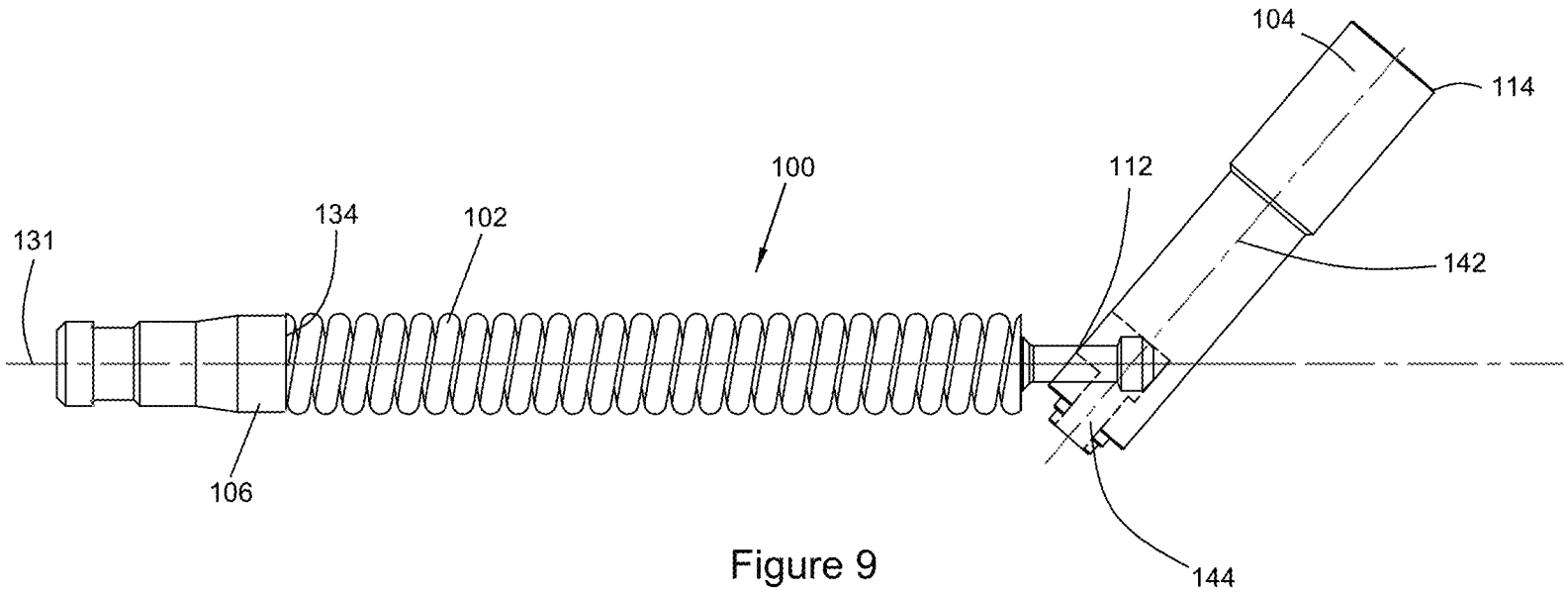
FIG. 9 is a side view of the bumper assembly with the flow cage rotated with respect to the impact head/mandrel.

In FIG. 9 the flow cage 104 is rotated generally about the intersection of impact head/mandrel 106's centerline 131 and flow cage 104's centerline 142 keeping the large portion of circumferential profile 112 having diameter $D_2$ within the interior bore 144 portion having diameter $D_4$. Flow cage 104 is rotated until impact head/mandrel 106's centerline 131 and flow cage 104's centerline are aligned.

Figure 10:
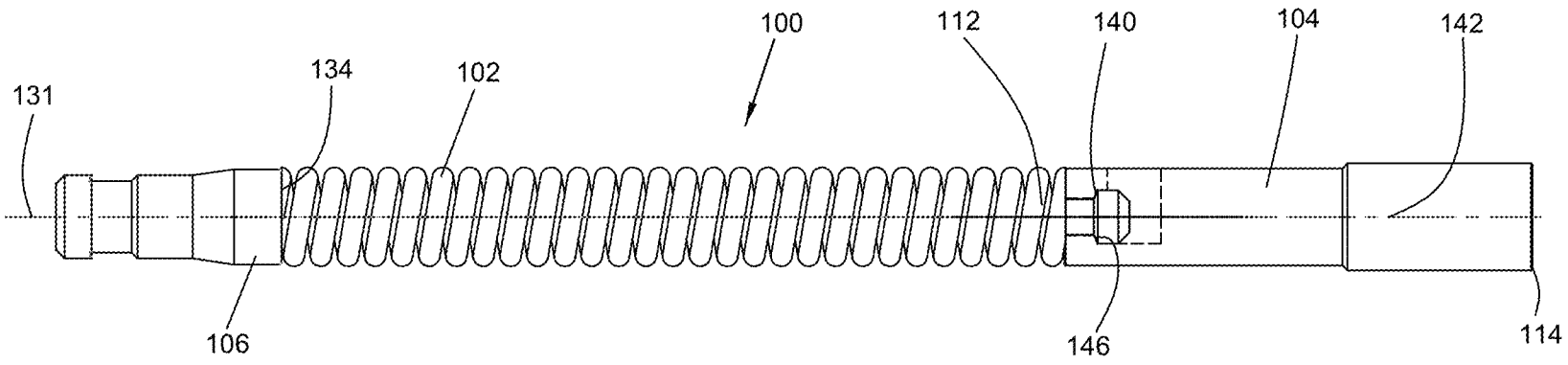
FIG. 10 is a side view of the bumper assembly with the circumferential profile shoulder landing on the flow cage shoulder.

In FIG. 10 flow cage 104 is moved such that circumferential profile 112's shoulder 140 lands on flow cage 104's shoulder 146. Generally, as can be seen in FIG. 5 shoulder 146 is some distance $D_5$ towards the upper end of the flow cage 104 away from enlarged portion 123 of slot 120. By being located some distance $D_5$ from enlarged portion 123 of slot 120 the large portion of circumferential profile 112 having diameter $D_2$ is prevented from simply moving radially outward and out of the slot. The spring 102 is now released applying a force through shoulder 140 on the large portion of circumferential profile 112 having diameter $D_2$ on shoulder 146 of flow cage 104. The applied force of the spring generally locks the impact head mandrel 106 to flow cage 104.

The methods and materials described as being used in a particular embodiment may be used in any other embodiment. While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A bumper spring assembly comprising:

a unitary impact head and mandrel, a spring, and a flow cage;

wherein the unitary impact head and mandrel has a lower end;

further wherein the unitary impact head and mandrel lower end includes a profile having a first shoulder;

wherein the flow cage has an upper end;

further wherein the flow cage upper end includes an internal profile having a second shoulder;

wherein the flow cage upper end includes a radially directed port;

wherein the radially directed port is configured to allow the unitary impact head lower end profile to be inserted into the interior of the flow cage through the radially directed port;

the unitary impact head lower end profile first shoulder cooperates with the flow cage upper end internal profile second shoulder such that the flow cage traps the spring on the mandrel section of the unitary impact head and mandrel.

2. A bumper spring assembly comprising:

a unitary impact head and mandrel, a spring, and a flow cage;

wherein the unitary impact head and mandrel has a lower end;

further wherein the unitary impact head and mandrel lower end includes a profile having a first shoulder;

wherein the flow cage has an upper end;

further wherein the flow cage upper end includes an internal profile having a second shoulder;

wherein the flow cage upper end includes a radially directed port;

wherein the radially directed port is configured to allow the unitary impact head lower end profile to be inserted into the interior of the flow cage through the radially directed port only when the unitary impact head lower end profile is at about a 90 degree angle to the long axis of the flow cage;

the unitary impact head lower end profile first shoulder cooperates with the flow cage upper end internal profile second shoulder such that the flow cage traps the spring on the mandrel section of the unitary impact head and mandrel.

3. A bumper spring assembly comprising:

a unitary impact head and mandrel, a spring, and a flow cage;

wherein the unitary impact head and mandrel has a lower end;

further wherein the unitary impact head and mandrel lower end includes a profile having a first shoulder;

wherein the flow cage has an upper end;

further wherein the flow cage upper end includes an internal profile having a second shoulder;

the unitary impact head lower end profile first shoulder cooperates with the flow cage upper end internal profile second shoulder such that the flow cage traps the spring on the mandrel section of the unitary impact head and mandrel;

wherein the spring provides an axially directed force such that the unitary impact head lower end profile first shoulder and the flow cage upper end internal profile second shoulder remain in contact so long as the axially directed force is provided.

4. A method of installing a spring in a bumper spring assembly comprising, compressing the spring, inserting a unitary impact head and mandrel lower end profile into a flow cage upper end internal profile, wherein the flow cage upper end includes a radially directed port, inserting the unitary impact head lower end profile into the interior of the flow cage through the radially directed port, releasing the spring, whereby a first shoulder on the unitary impact head and mandrel lower end profile contacts a second shoulder on the flow cage upper end internal profile.

5. A method of installing a spring in a bumper spring assembly comprising, compressing the spring, inserting a unitary impact head and mandrel lower end profile into a flow cage upper end internal profile, wherein the flow cage upper end includes a radially directed port, rotating the flow cage to an about 90 degree angle to the long axis of the unitary impact head and mandrel, and inserting the unitary impact head lower end profile into the interior of the flow cage through the radially directed port, releasing the spring, whereby a first shoulder on the unitary impact head and mandrel lower end profile contacts a second shoulder on the flow cage upper end internal profile.

6. A method of installing a spring in a bumper spring comprising, compressing a spring, wherein the spring provides an axially directed force such that the unitary impact head lower end profile first shoulder and the flow cage upper end internal profile second shoulder remain in contact so long as the axially directed force is provided inserting a unitary impact head and mandrel lower end profile into a flow cage upper end internal profile, releasing the spring, wherein a first shoulder on the unitary impact head and mandrel lower end profile contacts a second shoulder on the flow cage upper end internal profile.

* * * * *